US009282390B1

(12) United States Patent
Turdjian

(10) Patent No.: US 9,282,390 B1
(45) Date of Patent: Mar. 8, 2016

(54) DUAL MODE IN-EAR HEADPHONE

(71) Applicant: MOLDEX METRIC INC., Culver City, CA (US)

(72) Inventor: Crest Turdjian, Los Angeles, CA (US)

(73) Assignee: MOLDEX-METRIC, INC., Culver City, CA (US)

( * ) Notice: Subject to any disclaimer, the term of this patent is extended or adjusted under 35 U.S.C. 154(b) by 0 days.

(21) Appl. No.: 14/537,302

(22) Filed: Nov. 10, 2014

(51) Int. Cl.
*H04R 25/00* (2006.01)
*H04R 1/10* (2006.01)

(52) U.S. Cl.
CPC ..... *H04R 1/10* (2013.01)

(58) Field of Classification Search
CPC ..... H04R 1/10; H04R 1/1016; H04R 1/105; H04R 1/1075; H04R 2201/10
See application file for complete search history.

(56) References Cited

U.S. PATENT DOCUMENTS

RE40,696 E * 4/2009 Iseberg ..... H04R 1/1016 181/130
8,161,975 B2 * 4/2012 Turdjian ..... A61F 11/08 128/864
2007/0189569 A1 * 8/2007 Haapapuro ..... H04R 1/1016 381/380
2010/0294285 A1 * 11/2010 Turdjian ..... A61F 11/08 128/867
2010/0322453 A1 * 12/2010 Matsuyama ..... H04R 1/2857 381/380
2012/0243726 A1 * 9/2012 Hosoo ..... H04R 1/1016 381/380
2013/0034260 A1 * 2/2013 Greger ..... H04R 1/1066 381/380

* cited by examiner

*Primary Examiner* — Tuan D Nguyen
(74) *Attorney, Agent, or Firm* — Charles H Schwartz

(57) ABSTRACT

A multi-piece dual mode headphone, including: a molded elongated member, a rear molded insert member and an intermediate member all together forming a headphone with a channel extending through the interior of the headphone. A small speaker for transmitting sound energy is positioned in the headphone to direct the sound energy through the channel to the eardrum. The molded rear insert member includes a cap member and with positioning of the cap member providing for the headphone being in a first mode of operation where the channel extending through the interior of the headphone is open and a second mode of operation where the channel extending through the interior of the headphone is closed.

20 Claims, 2 Drawing Sheets

DUAL MODE IN-EAR HEADPHONE

BACKGROUND OF THE INVENTION

1. Field of the Invention

This invention relates to light weight headphones (known as earphones or ear buds) for controlling sound from portable radio communications, CD players, portable media players or mobile phones to the eardrum and also, when desired, allowing sound to the eardrum from outside of the ear. In particular, the invention is specifically directed to a Dual Mode In-Ear Headphone/Headset having selective characteristics including a two-position structure so that in a first position the device blocks out such external noise and in a second position the structure permits external sounds to enter the ear relatively unobstructed.

2. Prior Art

Since the invention of portable devices, such as portable radio communications, CD players, portable media players or mobile phones, the light weight headphones (known as earphones or ear buds) have become more popular. For the people who prefer a simple listening experience the new ear-fitting headphones are relatively inexpensive and more comfortable comparing to full-size over-ear headphones, as they are light in weight, small in size, they do not cover the ears and less pressure against the ears.

While there are various models of earphones available, in general they fall into two categories—either block the external noise or allow the ambient noise to seep in.

Typically the earphones that do not block the ambient noise are fitted in the outer ear, but not inserted in the ear canal, and the earphones that isolate the outside noise are inserted deep into the ear canal (known as in-ear headphone).

SUMMARY OF THE INVENTION

The present invention achieves the dual mode advantages described above and eliminates the deficiencies of the prior art. Based on the circumstances, the users may or may not want to isolate the external noise. For example, in a noisy environment with earphones that do not block the external noise, the users may turn up the volume dangerously high to compensate the external noise at the risk of causing hearing loss. On the other hand earphones that block out the ambient noise do not let the user be aware of the surroundings, for example, approaching vehicles which in some instances can be an important safety concern.

The following description and drawings illustrate the new and novel concept of an in-ear headphone with Dual Mode capabilities. The objective of the present design is to provide an earphone with both options described above. The Dual Mode In-Ear Headphone/Headset has selective characteristics including a two position structure. In one position the earphone blocks out much external noise and in the second position it permits external sounds to enter the ear relatively unobstructed. The user can easily switch between the two modes by simply opening and closing a cover without removing the earphone from the ear canal. Another advantage of the present design is that the earphone securely stays in the ear canal in both positions whereas most of the earphones that do not block the external noise are prone to falling out since they sit in the outer ear.

In particular, the present invention is simple in construction, simple in manufacture, and simple in use. It consists of only three parts (plus a small speaker) which can be molded individually and joined together in a simple manufacturing operation. The result is the headphone of the present invention that has two positions to provide two modes of operation. In one position the device blocks out most external noise and in the second position it permits external sounds to enter the ear relatively unobstructed. The present invention is easy to use since the switching between the two modes of operation is accomplished using one hand and without removing the headphone from the ear canal. Another feature of the present invention is that it is easy to determine which mode the headphone is in.

The headphone of the present invention is constructed of a front elongated member, an intermediate member and a rear insert member. The insert member, located at the rear, and the intermediate member together form part of the shaft or handle of the headphone. This rear insert member and the intermediate member are both made of a relatively hard polymeric material. The front elongated member forming the in-ear portion of the headphone is made of a relatively soft resilient material so as to be comfortable within the interior of the ear.

The headphone of the present invention is thereby formed by a shaft or handle composed of the rear and intermediate members. A small speaker is positioned within the shaft formed by the rear and intermediate members. The front elongated member extends from the shaft and has a nose end configuration that is typically a rounded cone shape so as to be easily inserted within the ear. The front elongated member can be any of a variety of shapes including a flanged structure, a tapered cone, a single flared cone structure and a stepped cone structure.

A clearer understanding of the invention will be had with reference to the following description and drawings wherein.

DETAILED DESCRIPTION OF THE INVENTION

Figure 1:
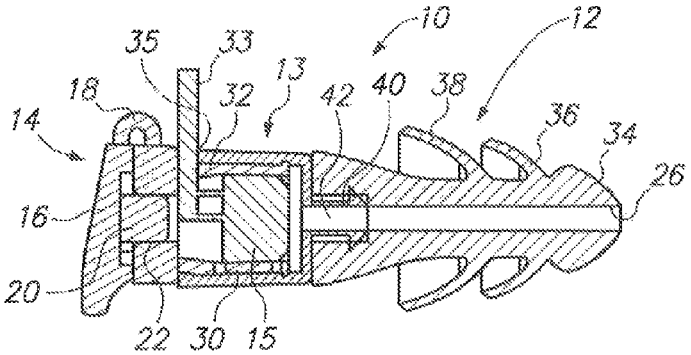
FIG. 1 is a cross-sectional view of the headphone of the present invention in a closed position for blocking out most external noise.
Figure 2:
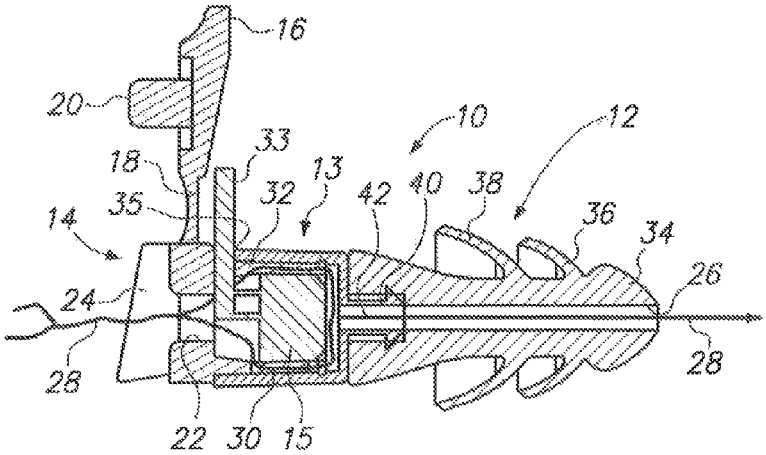
FIG. 2 is a cross-sectional view of the headphone of the present invention in the open position for permitting external sounds to enter the ear relatively unobstructed.

As shown in FIGS. 1 and 2, the headphone 10 of the present invention includes a front elongated member 12 forming a nosepiece, an intermediate member 13 and a rear insert member 14. A speaker 15 is located within the assembly of the intermediate member 13 and the rear insert member 14. In addition, the insert member 14 includes a living hinged cap member 16 attached to the body of the insert portion 14 by the living hinge 18. The cap member 16 includes a plug 20 that is used to switch the mode of operation by the insert member 14 from the closed position of FIG. 1 to the open position of FIG. 2. The back structure of the rear insert member 14 is similar in structure to that shown in U.S. Pat. No. 8,161,975, which patent is in a different art and used as part of a sound attenuating earplug and not a headphone for transmitting sound energy from a speaker.

Figure 4:
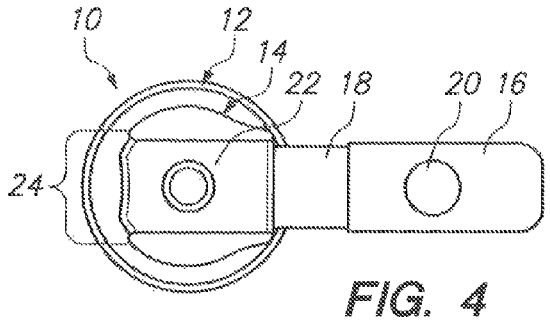
FIG. 4 is a top view of the rear insert member of the headphone in the open position.

This can be seen more clearly in the top view of FIG. 4 where it is seen that the insert member 14 includes an opening 22 and when the cap member 16 is in the closed position of FIG. 1, the plug 20 enters into the opening 22 to completely close off the opening 22. This blocks the headphone 10 from transmission of most of any external sound energy through the headphone so that the sound energy delivered to the eardrum is primarily from the speaker 15. The insert member 14 includes a base portion with a pair of sidewalls 24 so that the cap member 16 is guided in between the sidewalls 24 to ensure that the plug 20 is properly seated within the opening 22.

As shown in FIG. 2, when the cap 16 is in the open position, the plug is removed from the opening 22 and external sound can be transmitted through the opening 22, around the speaker 15 and through a passageway 26 in the front elongated member 12. This sound pathway is illustrated by the arrow 28 shown in FIG. 2. The rear insert member 14 includes two slots 30 and 32 shown in FIGS. 1-3 and also FIG. 5. The slots 30 and 32 are used as part of the pathway shown by the arrow 28. The slot 32 is also used to clear a flexible speaker cord 33 to allow the speaker 15 to be inserted into the rear insert member. After the speaker is inserted in the rear insert member 14, the rear insert member 14 is then inserted into the intermediate member 13 and the intermediate member covers the slot 32. The speaker cord 33 itself provides a seal for the cord 34 for external sounds since it is captured in a small opening 35 having a size and shape complementary to the cord 33.

Figure 3:
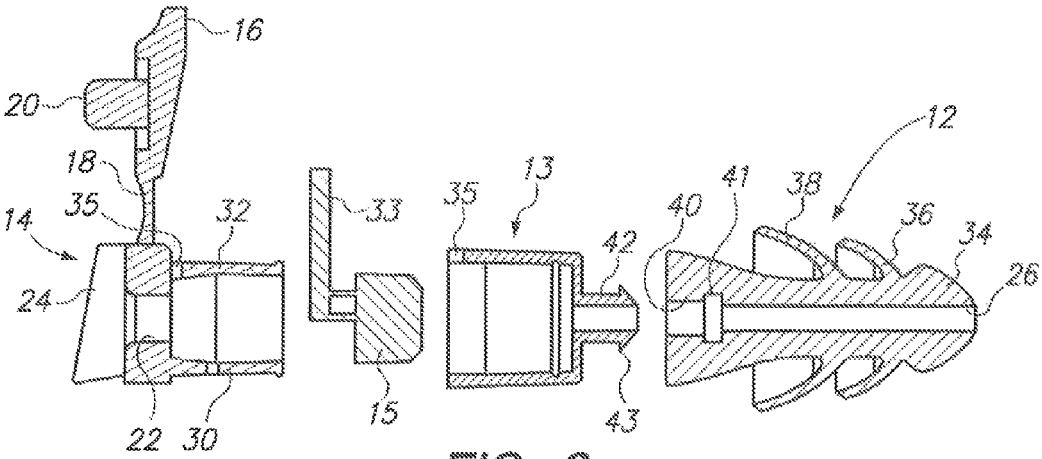
FIG. 3 is an exploded view of the various components forming the headphone in the open position and showing the different members before assembly.
Figure 5:
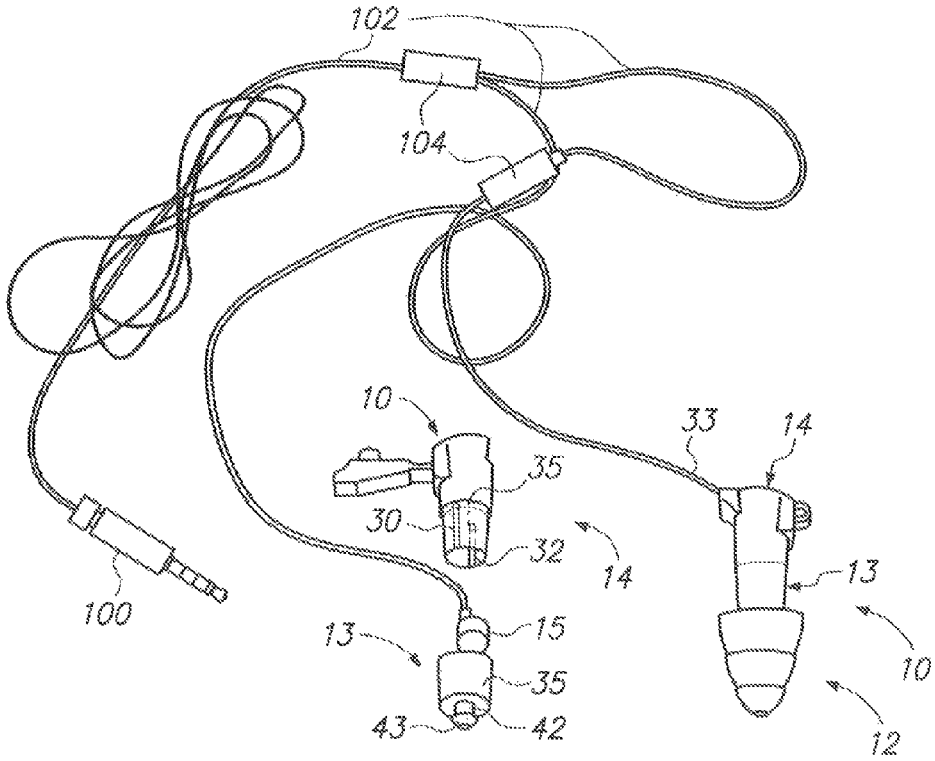
FIG. 5 is a view of the of the complete headphone including two earphones, one disassembled and the other assembled with a particular front elongated member, and FIG. 6(*a*) (b) and (c) illustrate additional types of front elongated members that can be used with the headphone of the present invention.
Figure 6:
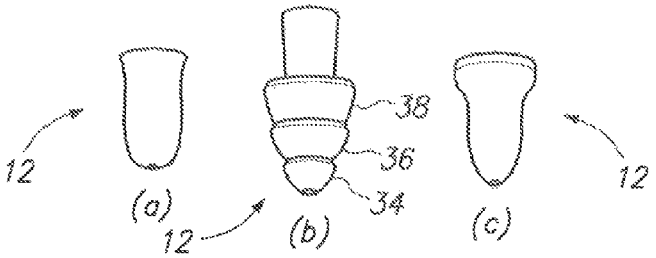

FIGS. 1-3 illustrate a cross-sectional view of one example of an elongated member 12 of the headphone of the present invention. In particular, the elongated member is shown to include a bulbous nose member 34 and a pair of flange members 36 and 38. This type of elongated member is also shown in FIG. 6(*b*). This elongated member 12 is shown to be a type shown in prior U.S. Pat. No. 5,957,136. It is to be appreciated that the elongated member 12 can take any shape either including flanges or not including flanges and other examples of elongated members 12 are shown in FIGS. 5 and 6(*a*) and (*c*). FIG. 5 illustrates a stepped cone, FIG. 6(*a*) illustrates a tapered cone and FIG. 6(*c*) illustrates a single flared cone. All of these varieties of the elongated member 12 can be made of various types of material such as the type of material disclosed in U.S. Pat. No. 5,957,136 or other materials including rubber-like materials or foam materials. Any of the external shapes of the elongated member 12 can be used as long as the internal structure of the elongated member is part of the headphone of the present invention.

In particular the internal structure of the elongated member 12 includes the channel 26 that extends completely there through. The channel 26 is formed with a portion 40 that interacts with a locking portion 42 of the intermediate member 13 to seat and mechanically lock the portion 42 in position within the portion 40 of the elongated member 12. The portion 40 may include a recess 41 and the portion 42 may include a projection 43 to enhance the interlocking of the portions 40 and 42. The recess 41 and the projection are best seen in FIG. 3.

The combination of an elongated member 12 made of material softer than the material of the intermediate member 13 and the rear insert member 14 also allows for the advantages of the intermediate member 13 and the rear insert member 14 forming a handle for insertion of the headphone in the ear canal. The headphone of the present invention can be fabricated by any suitable polymer molding techniques. It is important that the headphone be constructed of the proper resilient polymer material so as to have the combination of softness at the end of the headphone that is inserted into the ear and hardness at the rearward end to facilitate the insertion.

For example the elongated member 12 should be formulated of material that have a Shore A Durometer hardness value (by the technique of ASTM 2240-81) of between about 10 and 30 and preferably between 15 and 25. The intermediate member 13 and the rear insert member 14 should be composed of a resilient polymeric material having a higher Shore A Durometer hardness value between 50 and 120 and preferably between 70 and 90. In a preferred embodiment the elongated member 12 can have a Shore A Durometer hardness value of approximately 20 and the intermediate member 13 and the rear insert member 14 can have a Shore A Durometer hardness value of approximately 85.

There are many known resilient polymeric materials that may be used to form the headphones of the present invention. For example, natural rubber, neoprene rubber, SBR rubber (styrene block copolymer compounds), silicone rubber, EPDM rubber, polybutadiene rubber, polyvinylchloride elastomers and foams, polyurethane elastomers and foams, ethylene vinyl, acetate elastomers, elastomers based on acrylic acid precursors and vinyhalide polymers may all be generally suitable materials which can be used to provide the necessary Shore A Durometer values. As preferred materials, the present invention contemplates using a polyvinylchloride elastomer with low migration for the members 13 and 14 and SBR rubber for the elongated member 12 shown in FIGS. 1-3 and 6(*b*). For the examples of the elongated member 12 shown in FIGS. 5 and 6(*a*) and 6(*c*), typical resilient foam earplug material may also be used.

FIG. 5 illustrates a complete headphone set including two headphones, or headphone 10, one disassembled and the other assembled with a particular front elongated member 12 formed as a stepped cone. The full headphone set typically includes a standard jack 100, electrical wires 102 and any interconnectors 104 to supply sound signals to the headphones 10. The specific structure for the headphone set including the jack 100, the wires 102 and the connectors 104 can be of any conventional type to operate with the headphones 10 of the present invention.

The final combined structure can be seen in FIGS. 1 and 2 wherein the speaker 15 has been positioned in the rear insert member 14 which in turn has been inserted into the intermediate member 13 which in turn has been inserted into the elongated member 12 and where all of the various members are shown cooperating to provide for the operation of the present invention. As shown in FIG. 2, the headphone 10 is in the open position. In this mode of operation, outside external sounds can enter into the opening 22 to be passed into the interior of the headphone and thereby into the passageway 26 to the interior of the ear. Sounds produced by the speaker will still be transmitted to the interior of the ear but normal conversation and other outside noises can be heard but in somewhat attenuated form because of restrictions in the sound path through the headphone.

When the plug 20 engages into the opening 22 and thereby completely shuts off the headphone, then most external noise is blocked to the passageway 26. All of this is accomplished using the three parts 12, 13 and 14 that may be easily molded using conventional equipment. Moreover, the three parts plus the speaker 15 are interlocked in a very simple manner as shown in FIGS. 1-3. Also, the combined structure of the members 13 and 14 enclosing the speaker 15 is then connected to the member 12 using the interlocking portions 42 and 40 and it is only necessary to insert the portion 42 into the portion 40, push it in until these two portions 40 and 42 interlock to hold the headphone in the completed assembled position.

In general, the operation of the headphone 10 by a user is a follows:

When cap 16 is open, the headphone 10 can be used to hear sound produced by the speaker, such as music, while also allowing the user to hear outside noises such as conversation or traffic sounds. In the closed cap position the headphone can be used to hear continuous sounds from the speaker while blocking most outside sounds.

For use of the headphone without outside sounds, insert, as below, and wear with the cap 16 closed. Before inserting the headphone 10, check to see that cap 16 is fully closed. Grasp the rigid handle portion formed by the members 13 and 14 and gently push and wiggle each headphone into the ear canals until a good and comfortable seal is made.

For use when outside hearing is needed, wear with the cap 16 open and insert as above. If the headphone is already being worn with cap 16 closed, there is no need to take the headphone out to open cap. To open the cap 16, depending on the orientation of the rear insert member 14, use either the thumb or index finger to gently push out on the cap 16 while resting the other finger on the hinge 18. If you want to switch to use against outside sounds the cap must be closed. To close cap 16 there is no need to take headphone out. Depending on the orientation of the rear insert member 14, use either the thumb or index finger to gently push the cap 16 into the insert member 14.

It can therefore seem that all of the desirable features of the dual mode operation have been accomplished in the present invention. Moreover, the method and structure of switching between the open and closed positions for the two different modes of operation is very simply accomplished using the plug member 20 which engages an opening 22 and that is part of the insert member 14 using a living hinge 18. It is very simple to reach up and with one hand to switch the headphone from the closed position to the open positioned and then to re-engage the closed position by just pushing the cap portion 16 to have the plug engage the opening. This structure is much simpler in operation than any other prior art headphones.

The present invention has simplicity of manufacture using only three parts plus speaker and simplicity of the structure itself. All parts may be easily molded using conventional techniques and the present invention has simplicity of assembly by merely pushing the different members into each other to assemble the complete headphone. All of this greatly simplifies the structure and manufacturing. Moreover, the ease of operation from one mode to the other again increases the advantages of the present invention. The novel and unique combination of elements thereby lends a surprising structural advantage of the present invention over the prior art.

It is to be appreciated that the invention has been described with reference to a three part structure but the intermediate members and the elongated member may be integrally molded together to form a combined molded structure having the same characteristics as the separate members. The rear insert member is then inserted into this integrally molded structure.

As indicated above, the elongated member may take any form and although the invention has been described with reference to a particular embodiment it is to be appreciated that various adaptations and modifications may be made and the invention is only to be limited by the appended claims.

The invention claimed is:

1. A multi-piece dual mode headphone and with each piece molded of resilient polymeric material for insertion into an ear canal, including:

a molded elongated member having a nose end and an open rear end and a channel extending through the interior of the molded elongated member from the open rear end to the nose end, a molded insert member formed with a base portion and a hollow rod portion and with the hollow rod portion seated within the open rear end of the molded elongated member and extending into the channel of the elongated member and with the base portion extending out from the open rear end of the elongated member and serving as a handle for aiding insertion of the headphone into an ear canal, a small speaker for transmitting sound energy, the molded insert member additionally including a recess chamber for receiving and supporting the small speaker to direct the sound energy through the hollow rod portion and toward the channel in the elongated member, the molded insert member also including the base portion including a first opening leading to the hollow rod portion and with the first opening and the hollow rod portion together forming a passageway through the insert member to the channel extending through the interior of the molded elongated member, the molded insert member further including a molded cap member and with the cap member including a plug portion having a size complementary to the first opening of the base member wherein the insertion of the plug portion into the first opening of the base portion seals off the first opening and with positioning of the cap member providing for the headphone being in a first mode of operation where the passageway through the insert member to the channel extending through the interior of the elongated member is open and a second mode of operation where the passageway through the insert member to the channel extending through the interior of the molded elongated member is closed, and the elongated member composed of a resilient polymer material having a relatively low Shore A Durometer hardness value and the insert member composed of a resilient polymeric material having a relatively high Shore A Durometer hardness value so that the insert member forms a handle of greater stiffness to enable the elongated member to be more easily inserted into the ear canal and allows the cap member to be easily switched between the two modes of operation of the headphone with one hand without removing the headphone from the ear canal.

2. The multi-piece headphone of claim 1 wherein the exterior configuration of the rod portion of the molded insert member is substantially the same as the interior configuration of the open rear end of the elongated member.

3. The multi-piece headphone of claim 2 wherein the rod portion of the molded insert member and the open rear end of the molded elongated member have complementary interlocking recess and projecting portions to mechanically lock the rod portion of the molded insert member within the open rear end of the molded elongated member when they are seated.

4. The multi-piece headphone of claim 1 wherein the molded insert member is formed by a rear member and an intermediate member and with the recess chamber for receiving and supporting the small speaker located in the rear member and with the intermediate member overlaying the recess chamber and sealing the speaker in the rear member and with the hollow rod portion extending from the intermediate member when the intermediate member overlays the recess chamber to direct the sound energy through the hollow rod portion and toward the channel in the elongated member.

5. The multi-piece headphone of claim 1 wherein the cap member is attached to the base portion of the insert molded member by a molded hinge member and with the positioning of the cap member provided by moving the cap member using the hinge member.

6. The multi-piece headphone of claim 1 wherein the molded elongated member includes at least two hollow rearwardly extending flange elements of serially increasing diameters and with the nose end having a smaller diameter than any of the flange elements.

7. The multi-piece headphone of claim 1 wherein the base portion of the molded insert member is of substantially the same diameter as the rear end of the molded elongated member to form a smooth shaft portion rearward of the molded elongated member.

8. The multi-piece headphone of claim 1 wherein the rod portion is mechanically seated within the open rear end of the molded elongated member.

9. The multi-piece headphone of claim 1 wherein the molded elongated member is composed of a resilient polymeric material having a Shore A Durometer hardness value of between 10 and 30 and the molded insert member is composed of a resilient polymeric material having a Shore A Durometer hardness value of between 50 and 120.

10. The multi-piece headphone of claim 1 wherein the molded elongated member has a Shore A Durometer hardness value of between 15 and 25 and the molded insert member has a Shore A Durometer hardness value of between 80 and 90.

11. A multi-piece dual mode headphone and with each piece molded of resilient polymeric material for insertion into an ear canal, including:

a molded elongated member having a nose end and an open rear end and a channel extending through the interior of the molded elongated member from the open rear end to the nose end, a rear molded insert member formed with a base portion and an extending portion, an intermediate member formed to receive and overlay the extending portion of the rear molded insert member and including a hollow rod portion and with the hollow rod portion seated within the open rear end of the molded elongated member and extending into the channel of the elongated member and with the base portion of the rear molded insert member together with the overlaying intermediate member extending out from the open rear end of the elongated member and serving as a handle for aiding insertion of the headphone into an ear canal, a small speaker for transmitting sound energy, the molded rear insert member additionally including a recess chamber in the extending portion for receiving and supporting the small speaker to direct the sound energy through the hollow rod portion of the intermediate member and toward the channel in the elongated member the molded rear insert member also including the base portion including a first opening leading to the hollow rod portion and with the first opening and the hollow rod portion together forming a passageway through the insert member to the channel extending through the interior of the molded elongated member, and the molded rear insert member further including a molded cap member and with the cap member including a plug portion having a size complementary to the first opening of the base member wherein the insertion of the plug portion into the first opening of the base portion seals off the first opening and with positioning of the cap member providing for the headphone being in a first mode of operation where the passageway through the insert member to the channel extending through the interior of the elongated member is open and a second mode of operation where the passageway through the insert member to the channel extending through the interior of the molded elongated member is closed.

12. The multi-piece headphone of claim 11 wherein the exterior configuration of the rod portion of the intermediate member is substantially the same as the interior configuration of the open rear end of the molded elongated member.

13. The multi-piece headphone of claim 12 wherein the rod portion of the intermediate member and the open rear end of the molded elongated member have complementary interlocking portions to mechanically lock the rod portion of the molded insert member within the open rear end of the molded elongated member when they are seated.

14. The multi-piece headphone of claim 11 wherein the cap member is attached to the base portion of the molded rear insert member by a molded hinge member and with the positioning of the cap member provided by moving the cap member using the molded hinge member.

15. The multi-piece headphone of claim 11 wherein the molded elongated member includes at least two hollow rearwardly extending flange elements of serially increasing diameters and with the nose end having a smaller diameter than any of the flange elements.

16. The multi-piece headphone of claim 11 wherein the molded elongated member is formed as a smooth tapered cone.

17. The multi-piece headphone of claim 11 wherein the molded elongated member is formed as a smooth tapered flanged cone.

18. The multi-piece headphone of claim 11 wherein the molded elongated member is formed as a smooth tapered stepped cone.

19. The multi-piece headphone of claim 11 wherein the overlaying portion of the intermediate member is of substantially the same diameter as the rear end of the molded elongated member to form a smooth shaft portion rearward of the molded elongated member.

20. The multi-piece headphone of claim 11 wherein the speaker member is mechanically seated within the recess chamber in the rear insert member, the extending portion of the rear insert member is mechanically seated within the overlaying structure of the intermediate member to seal the speaker member within the recess chamber and the rod portion of the intermediate member is mechanically seated within the open rear end of the molded elongated member.

* * * * *